US007399170B2

(12) United States Patent
Aya et al.

(10) Patent No.: US 7,399,170 B2
(45) Date of Patent: Jul. 15, 2008

(54) HERMETIC ROTARY COMPRESSOR AND REFRIGERATING CYCLE DEVICE USING THE SAME

(75) Inventors: Toru Aya, Shiga (JP); Toshiharu Yasu, Shiga (JP); Hiroshi Matsunaga, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 293 days.

(21) Appl. No.: 11/393,491

(22) Filed: Mar. 30, 2006

(65) Prior Publication Data

US 2006/0225456 A1 Oct. 12, 2006

(30) Foreign Application Priority Data

Apr. 8, 2005 (JP) ..... 2005-112009

(51) Int. Cl.
*F03C 2/00* (2006.01)
*F04C 2/00* (2006.01)

(52) U.S. Cl. ..... 418/60; 418/63

(58) Field of Classification Search ..... 418/155, 418/22, 23, 24, 60, 62, 63, 65
See application file for complete search history.

(56) References Cited

U.S. PATENT DOCUMENTS 4,780,067 A * 10/1988 Suzuki et al. ..... 418/60
5,013,217 A * 5/1991 Hitosugi ..... 417/26
5,170,636 A * 12/1992 Hitosugi ..... 62/175
7,290,994 B2 * 11/2007 Kitaichi et al. ..... 418/60
2004/0009083 A1 * 1/2004 Kim et al. ..... 418/63
2005/0214137 A1 * 9/2005 Sakaniwa et al. ..... 417/410.3
2006/0002809 A1 * 1/2006 Kawabe et al. ..... 418/63
2006/0008360 A1 * 1/2006 Nishikawa et al. ..... 417/244
2006/0140802 A1 * 6/2006 Ogasawara et al. ..... 418/5

FOREIGN PATENT DOCUMENTS

JP 63057889 A * 3/1988
JP 01-247786 10/1989

* cited by examiner

*Primary Examiner*—Thomas Denion
*Assistant Examiner*—Mary A Davis
(74) *Attorney, Agent, or Firm*—RatnerPrestia

(57) ABSTRACT

In a two-cylinder type hermetic rotary compressor, a first cylinder continually operates due to a spring member biasing a first vane. A pressure introducing pipe is connected to a second vane room arranged in a second cylinder. The second cylinder stops and starts operation by introducing sucking pressure or discharge pressure from the pressure introducing pipe. A discharge pressure introducing pipe that is connected to a portion of a hermetic case below the oil face of the lubricating oil is connected to the pressure introducing pipe.

8 Claims, 3 Drawing Sheets

HERMETIC ROTARY COMPRESSOR AND REFRIGERATING CYCLE DEVICE USING THE SAME

BACKGROUND OF THE INVENTION

1. Technical Field

The present invention relates to a hermetic rotary compressor having two cylinders and capable of changing performance by simultaneously performing a compressing operation by both the cylinders and interrupting the compressing operation in one of the cylinders and reducing a compressing work. The present invention also relates to a refrigerating cycle device using the hermetic rotary compressor.

2. Background Art

In the general hermetic rotary compressor, an electric motor section and a compressing mechanism section connected to the electric motor section are stored in a hermetic case. The compressing mechanism section compresses a cooling medium gas, and discharges once the cooling medium gas into the hermetic case. Thus, the interior of the hermetic case is of a high pressure. In the compressing mechanism section, a piston is stored in a cylinder room arranged in the cylinder. Further, a vane room is arranged in the cylinder, and a vane is slidably stored in the vane room. A tip edge of the vane is projected onto the cylinder room side, and is pressed and biased by a compression spring so as to elastically contact with the circumferential face of the piston.

Accordingly, the cylinder room is partitioned into two rooms along the rotating direction of the piston by the vane. A sucking section is communicates with one side of one of the rooms, and a discharging section is communicates with the other side of the room. A sucking pipe is connected to the sucking section, and the discharging section is opened to the hermetic case.

In recent years, a hermetic rotary compressor of a two-cylinder type having two sets of cylinders arranged vertically has tended to become standard. In such a compressor, if a cylinder for always (continuously) performing the compressing operation and another cylinder capable of switching between compression and stoppage (non-operation) are arranged, a usable performance range is enlarged so as to be advantageous.

For example, in Japanese Patent Unexamined Publication No. H1-247786, a rotary compressor having two cylinder rooms is disclosed. In this rotary compressor, a high pressure introducing section is provided. The high pressure introducing section compulsorily separates a vane of one of the cylinder rooms from a roller, holds the vane, and sets the cylinder room to a high pressure. The high pressure introducing section thereby interrupts the compressing operation as needed.

In this kind of the compressor, the vane is compulsorily separated from the piston and is held when the other cylinder room is compressed and operated while the operation of one cylinder room is stopped. Therefore, a closing vane room is arranged on the rear face side of the vane. In this compressor, however, vane room does not communicate with the interior of the compressor, and a so-called closing room is formed. Therefore, lubricating oil retained within the hermetic case is not sufficiently supplied to a sliding portion of the vane so that wear, burning, etc. are generated.

SUMMARY OF THE INVENTION

The hermetic rotary compressor of the present invention is a two-cylinder type hermetic rotary compressor. Since a spring member biases a first vane, a first cylinder is continuously compressed and operated. A pressure introducing pipe is connected to a second vane room arranged in a second cylinder. The second cylinder is stopped in operation and is operated by introducing sucking pressure (e.g., low pressure) or discharging pressure (high pressure) from the pressure introducing pipe. A discharging pressure introducing pipe connected to a portion of a hermetic case below the oil face of the lubricating oil is connected to the pressure introducing pipe.

DETAILED DESCRIPTION OF THE INVENTION

Figure 1:
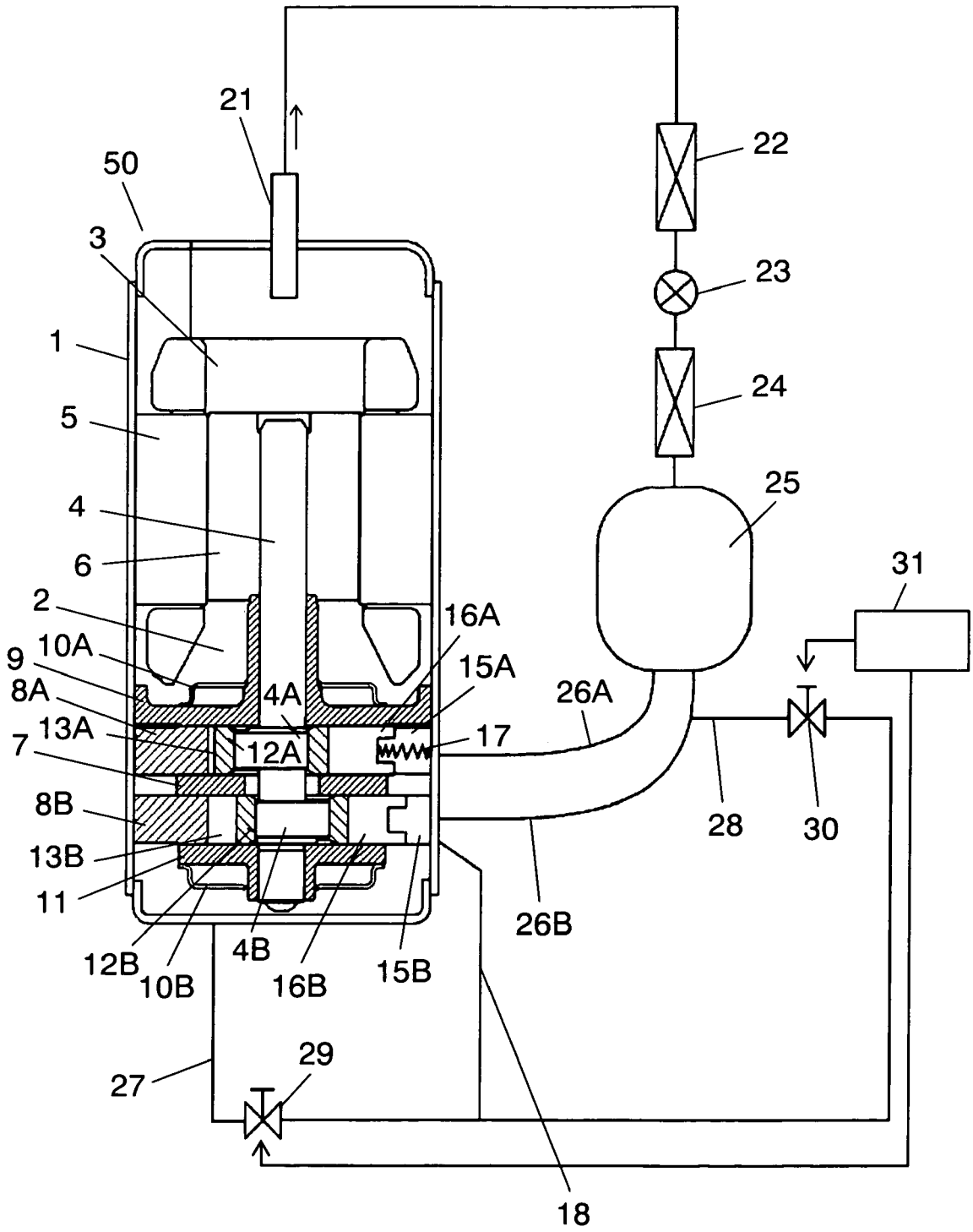
FIG. 1 is a view showing the longitudinal section of a hermetic rotary compressor and the construction of a refrigerating cycle device in accordance with an exemplary embodiment of the present invention.
Figure 2:
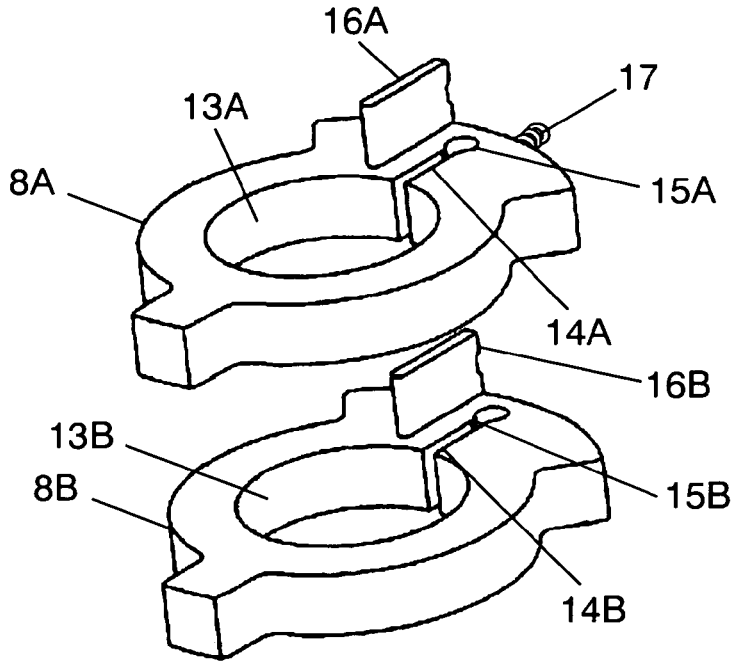
FIG. 2 is an exploded perspective view of a first cylinder and a second cylinder of the hermetic rotary compressor shown in FIG. 1.

FIG. 1 shows the sectional structure of a hermetic rotary compressor in accordance with an exemplary embodiment of the present invention. Compressing mechanism section 2 is arranged in the lower portion of the interior of hermetic case 1. Electric motor section 3 is arranged in the upper portion of the interior of hermetic case 1. Electric motor section 3 and compressing mechanism section 2 are connected through rotating shaft 4.

Electric motor section 3 is constructed by stator 5 fixed to the inner face of hermetic case 1, and rotor 6 arranged inside stator 5 through a predetermined clearance. Rotating shaft 4 is inserted into and fixed with rotor 6.

Compressing mechanism section 2 has first cylinder 8A and second cylinder 8B in the lower portion of rotating shaft 4. Cylinder 8A and cylinder 8B are vertically arranged through intermediate partition plate 7.

Main bearing 9 is overlaps with the upper face of cylinder 8A, and is fixed with cylinder 8A together with first valve cover 10A. Sub-bearing 11 is overlaps with the lower face of cylinder 8B, and is fixed with cylinder 8B together with second valve cover 10B. Discharge ports of cylinders 8A, 8B opening into hermetic case 1 are respectively arranged in valve covers 10A, 10B.

Rotating shaft 4 is rotatably supported by main bearing 9 and sub-bearing 11. Further, rotating shaft 4 extends through the interior of each of cylinders 8A, 8B, and is fixed to first eccentric portion 4A and second eccentric portion 4B. Eccentric portions 4A and 4B are formed with a phase difference of about 180°.

The detailed structure of cylinders 8A, 8B will next be explained. Eccentric portions 4A, 4B each have the same diameter, and are respectively assembled so as to be located in the inside portions of cylinders 8A, 8B. First eccentric roller 12A and second eccentric roller 12B each having the same diameter are fitted to the circumferential faces of respective eccentric portions 4A, 4B. Eccentric rollers 12A, 12B connect to rotor 6 of electric motor section 3 through rotating shaft 4. Namely, eccentric roller 12B coaxially connects to electric motor section 3 with respect to eccentric roller 12A.

In each of cylinders 8A, 8B, first cylinder room 13A and second cylinder room 13B, and first vane groove 14A and second vane groove 14B communicating with cylinder rooms 13A, 13B are respectively arranged. Further, first vane room 15A and second vane room 15B are arranged on the sides opposite cylinder rooms 13A, 13B, of grooves 14A, 14B. Eccentric rollers 12A, 12B are respectively eccentrically rotatably stored in cylinder rooms 13A, 13B.

Vanes 16A, 16B are stored in respective grooves 14A, 14B so as to be freely projected and recessed with respect to cylinder rooms 13A, 13B. Spring member 17 is stored in vane room 15A. Spring member 17 interposes between an end face of the rear side of vane 16A and the inner circumferential face of hermetic case 1. Spring member 17, as a compression spring, provides elastic force (back pressure) to vane 16A, and causes a tip edge of vane 16A to be in contact with first eccentric roller 12A. The tip edges of respective vanes 16A, 16B are formed in a semicircular shape, and come in line-contact with the circumferential walls of eccentric rollers 12A, 12B of the circular shape irrespective of rotating angles of eccentric rollers 12A, 12B.

Vane room 15A and a rear end portion of vane 16A communicate with the interior of hermetic case 1. Therefore, vane room 15A and the rear end portion of vane 16A directly receive the pressure within hermetic case 1. Namely, since vane 16A is slidably stored in vane room 15A, and the rear end portion is located in vane room 15A, the pressure within hermetic case 1 is directly applied.

Figure 3:
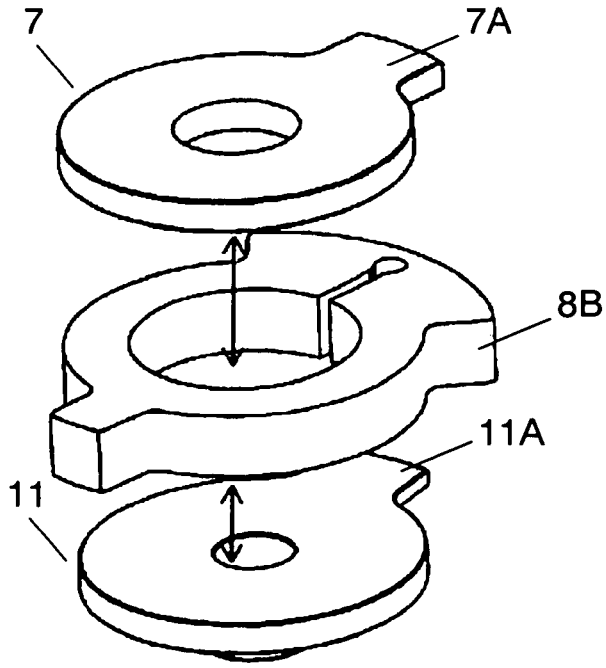
FIG. 3 is an exploded perspective view of the second cylinder, an intermediate partition plate and a sub-bearing of the hermetic rotary compressor shown in FIG. 1.

On the other hand, vane room 15B does not communicate with the interior of hermetic case 1, and forms a separate independent closing space. The structure of second vane room 15B will be explained by using FIG. 3. Closing lid portions 7A, 11A are provided in intermediate partition plate 7 and sub-bearing 11, both fixed to cylinder 8B. Upper and lower opening portions of vane groove 14B and vane room 15B as portions opening into hermetic case 1 in cylinder 8B are closed by fixing closing lid portions 7A, 11A to cylinder 8B.

Figure 4:
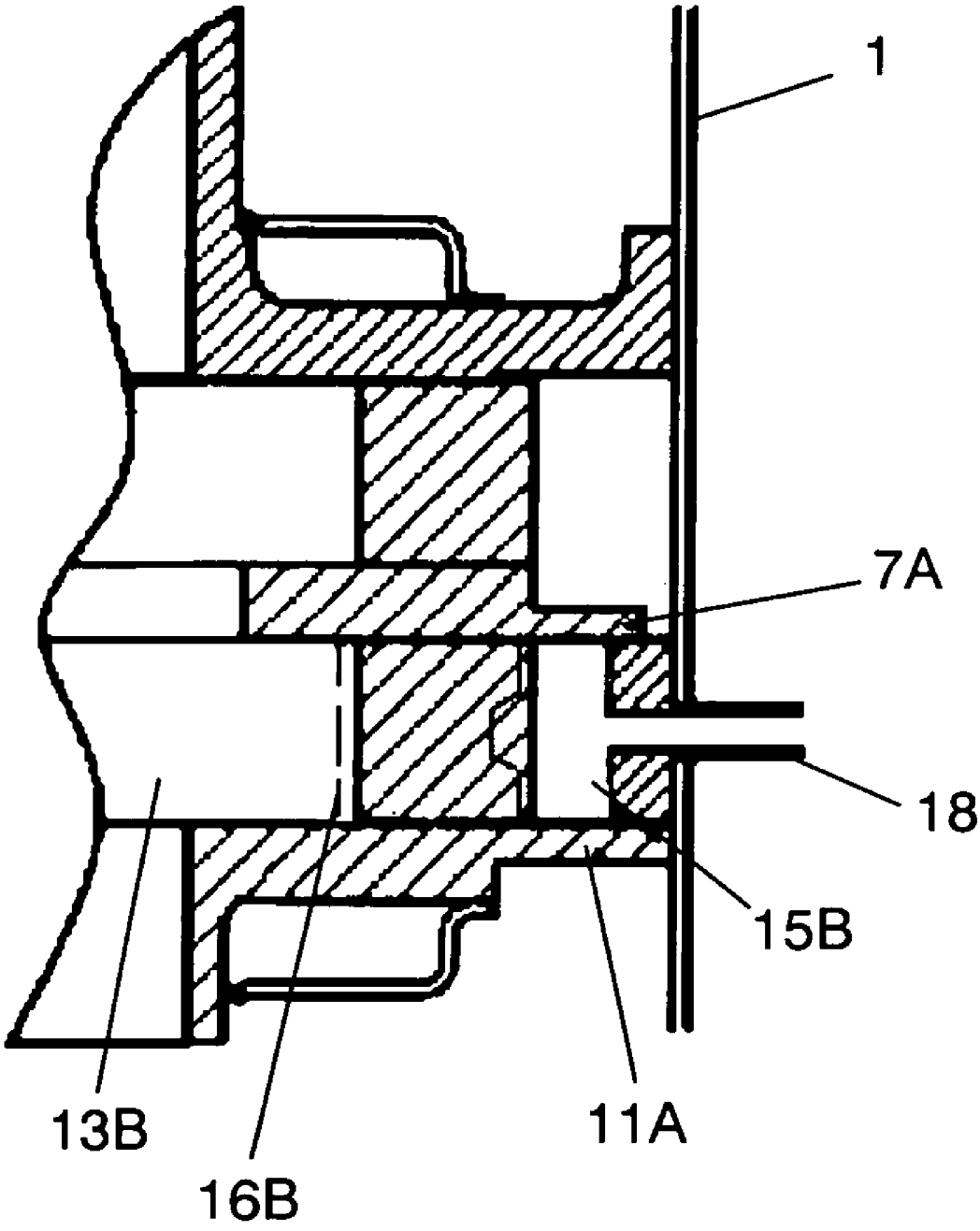
FIG. 4 is a cross-sectional view of a compressing mechanism section of the hermetic rotary compressor shown in FIG. 1.

FIG. 4 shows a cross-sectional view in a fixing state of intermediate partition plate 7 and sub-bearing 11. Vane room 15B forming the closing space communicates with the exterior of hermetic case 1 through pressure introducing pipe 18 arranged in the rear portion of vane room 15B. Namely, pressure introducing pipe 18 communicates with the interior of vane room 15B. Vane room 15B and the rear end portion of vane 16B receive pressure guided by pressure introducing pipe 18. The tip of vane 16B (shown as broken line portion) is directed to cylinder room 13B, and receives the pressure within cylinder room 13B. As a result, vane 16B is moved from the large pressure side to the small pressure side in accordance with the degree of difference in the mutual pressure applied to the tip portion and the rear end portion thereof.

The operation and action of the compressor in accordance with the present embodiment will next be described. Discharge pipe 21 is connected to an upper end portion of hermetic case 1. Discharge pipe 21 is connected to accumulator 25 through condenser 22, expansion mechanism 23 and evaporator 24. First sucking pipe 26A and second sucking pipe 26B with respect to compressor 50 are connected to the bottom portion of accumulator 25. Sucking pipe 26A extends through hermetic case 1 and a side portion of cylinder 8A, and directly communicates with the interior of cylinder room 13A. Sucking pipe 26B extends through hermetic case 1 and a side portion of cylinder 8B, and directly communicates with the interior of cylinder room 13B.

Discharge pressure introducing pipe 27 for introducing the discharge pressure within hermetic case 1 to vane room 15B is arranged on hermetic case 1. Discharge pressure introducing pipe 27 is attached to the bottom portion of hermetic case 1. Further, sucking pressure introducing pipe 28 is arranged so as to be branched from an intermediate portion of sucking pipe 26B. Sucking pressure introducing pipe 28 is joints to discharge pressure introducing pipe 27 and becomes pressure introducing pipe 18 and is guided to second vane room 15B. First opening-closing valve 29 is arranged on the upstream side from the joining portion of discharge pressure introducing pipe 27 to sucking pressure introducing pipe 28. Second opening-closing valve 30 is similarly arranged in sucking pressure introducing pipe 28. Namely, valve 29 is arranged between discharge pressure introducing pipe 27 and pressure introducing pipe 18, and valve 30 is arranged between sucking pressure introducing pipe 28 and pressure introducing pipe 18. Each of valves 29, 30 is constructed by an electromagnetic valve, and is controlled so as to be opened or closed corresponding to an electric signal from controller 31.

Thus, a pressure switching mechanism is constructed by discharge pressure introducing pipe 27 connected to vane room 15B, sucking pressure introducing pipe 28 and valves 29, 30. The sucking pressure from sucking pressure introducing pipe 28 or the discharge pressure from discharge pressure introducing pipe 27 is introduced to vane room 15B of cylinder 8B in accordance with a switching operation of the pressure switching mechanism.

Next, the operation of a refrigerating cycle device using hermetic rotary compressor 50 will be explained. First, when a normal operation (full performance operation) is selected, controller 31 opens valve 29 and closes valve 30.

In cylinder 8A, vane 16A is always elastically pressed and biased by spring member 17. Therefore, the tip edge of vane 16A abuts on the circumferential face of eccentric roller 12A, and the interior of cylinder room 13A is divided into a sucking room and a compressing room along the rotating direction of eccentric roller 12A. Cooling medium gas within cylinder room 13A is then compressed as eccentric roller 12A is rotated. When rotating shaft 4 is continuously rotated, the cooling medium gas attaining high pressure is discharged and filled within hermetic case 1 through valve cover 10A, and is discharged from discharge pipe 21 at the upper portion of hermetic case 1.

At this time, since valve 29 is opened, the high pressure gas is introduced from discharge pressure introducing pipe 27 to vane room 15B via pressure introducing pipe 18. On the other hand, cylinder room 13B attains a sucking pressure (low pressure) atmosphere. Thus, the tip portion of vane 16B attains a low pressure condition, and the rear end portion of vane 16B attains a high pressure condition. Therefore, vane 16B is pressed and biased so as to come in slide contact with eccentric roller 12B. Thus, the tip edge of vane 16B abuts on the circumferential face of eccentric roller 12B, and the interior of cylinder room 13B is divided into a sucking room and a compressing room along the rotating direction of eccentric roller 12B. Cooling medium gas within cylinder room 13B is then compressed as eccentric roller 12B is rotated. Namely, the compressing operation is performed in both cylinder rooms 13A and 13B, and the full performance operation is performed.

Next, when a special operation (an operation for reducing compression performance by half) is selected, controller 31 closes valve 29 and opens valve 30. As mentioned above, the normal compressing operation is performed in cylinder room 13A, and the interior of hermetic case 1 is filled with the discharged high pressure gas and becomes high pressure.

Sucking pressure is introduced to vane room 15B through sucking pressure introducing pipe 28. On the other hand, the sucking pressure is also introduced to cylinder room 15B via sucking pipe 26B and accumulator 25. Therefore, vane 16B is placed under a low pressure atmosphere in both of the front and rear end portions, and no differential pressure exists in the front and rear end portions.

However, a rotating movement of eccentric roller 12B is made within cylinder room 13B. Therefore, vane 16B is compulsorily stored to vane room 15B by centrifugal force, and keeps a stopping state (non-operation state) by separating vane 16 from the outer circumferential face of eccentric roller 12B. Accordingly, no compressing operation is performed in cylinder room 13B, and only the compressing operation in cylinder room 13A is performed. Thus, hermetic rotary compressor 50 is operated with its performance reduced by half.

As mentioned above, it is possible to operate hermetic rotary compressor 50 in two operating modes including the normal operation (full performance operation) and the special operation (performance half-reducing operation). Here, the high pressure gas introduced to vane room 15B in hermetic rotary compressor 50 is led out of the bottom portion of hermetic case 1.

Lubricating oil is always retained in the inner bottom portion of hermetic case 1 irrespective of an operating state. Accordingly, the lubricating oil is guided to vane room 15B by the cooling medium gas of high pressure at the normal operation (full performance operation). Accordingly, a sufficient amount of the lubricating oil is supplied to vane groove 14B, and no problem such as wear, burning, etc. of a sliding portion of vane 16B is generated. At the special operation (performance half-reducing operation), it seems that a low pressure gas is introduced to vane room 15B and the supply of the lubricating oil becomes insufficient. However, at the special operation, no compressing operation is performed in cylinder 8B, and the vane itself is at rest. Therefore, it is not necessary to consider wear, burning, etc.

It is not necessary to limit the attaching position of discharge pressure introducing pipe 27 to the bottom portion of hermetic case 1, but it is sufficient to set this attaching position to be located below the oil face of the lubricating oil during the operating time.

In recent years, a compressor using a hydrocarbon cooling medium and a fluorohydrocarbon cooling medium including no chlorine has been developed from the viewpoint of ozone layer protection. Such a cooling medium can be also used in the compressor having this mechanism. Further, a compressor using a natural cooling medium, such as carbon dioxide and ammonia, has been developed from the viewpoint of preventing the earth from warming. The present invention also can be applied to the compressor using such a natural cooling medium.

In FIG. 1, cylinders 8A, 8B are vertically arranged on the lower side of electric motor section 3, but the present invention is not limited to this construction. Cylinder 8A and cylinder 8B also may be arranged vertically sandwiching electric motor section 3. Namely, it is sufficient to arrange cylinder 8B in a position separated from cylinder 8A within hermetic case 1. Further, in FIG. 1, electric motor section 3 and cylinders 8A, 8B are arranged in the vertical direction, but the present invention is not limited to this arrangement. A hermetic rotary compressor of a transversal arranging type for arranging these members in the horizontal direction can be also arranged. In each of these cases, it is sufficient to arrange discharge pressure introducing pipe 27 below the oil face of the lubricating oil during the operating time.

Valves 29, 30 are constructed by an electromagnetic valve, but also may be constructed by a valve of a manual type. In this case, no controller 31 is required. Further, in a joining position of discharge pressure introducing pipe 27 and sucking pressure introducing pipe 28, a three-way valve for switching connection from these introducing pipes to pressure introducing pipe 18 also may be arranged instead of valves 29, 30. The pressure switching mechanism also can be constructed by such an arrangement.

As mentioned above, in the hermetic rotary compressor in the present invention, wear of a sliding portion of the vane is prevented and reliability is improved. Accordingly, the present invention also can be applied to uses such as a refrigerating air conditioner required to vary performance over a wide range, a water heater using a heat pump, etc.

What is claimed is:

1. A hermetic rotary compressor comprising:

a hermetic case for retaining lubricating oil in an inner bottom portion thereof;

an electric motor section arranged within the hermetic case; and a compressing mechanism section of a rotary type having:

a first cylinder including a first eccentric roller connected to the electric motor section, and a first cylinder room for eccentrically rotatably storing the first eccentric roller, the first cylinder being arranged within the hermetic case;

a first vane for dividing the first cylinder room into two portions along the rotating direction of the first eccentric roller, the first vane being arranged within the first cylinder and pressed and biased so as to make a tip edge thereof abut on a circumferential face of the first eccentric roller;

a first vane room for storing a side end portion of the first vane, the first vane room being arranged on a side opposite the first cylinder room with respect to the first vane;

a spring member for pressing and biasing the first vane, the spring member being arranged in the first vane room;

a second cylinder including a second eccentric roller coaxially connected to the electric motor section with respect to the first eccentric roller, and a second cylinder room for eccentrically rotatably storing the second eccentric roller, the second cylinder being arranged in a position separated from a position of the first cylinder within the hermetic case;

a second vane for dividing the second cylinder room into two portions along the rotating direction of the second eccentric roller, the second vane being arranged within the second cylinder and pressed and biased so as to make a tip edge of the second vane abut on a circumferential face of the second eccentric roller; and a second vane room for storing a side end portion of the second vane, the second vane room being arranged on a side opposite the second cylinder room with respect to the second vane;

wherein cooling medium gas compressed in the compressing mechanism section is discharged into the hermetic case and the interior of the hermetic case becomes high pressure;

the second vane is pressed and biased when the cooling medium gas of low pressure is introduced to the second vane room, and the second vane is separated and held when the cooling medium gas of discharging pressure is introduced to the second vane room; and a discharge pressure introducing pipe as an introducing port of the high pressure cooling medium gas from the hermetic case to the second vane room is arranged below an oil face of the lubricating oil during an operating time.

2. The hermetic rotary compressor according to claim 1, wherein the cooling medium is a chlorine free cooling medium.

3. The hermetic rotary compressor according to claim 2, wherein the cooling medium is one of hydrocarbon and fluorohydrocarbon.

4. The hermetic rotary compressor according to claim 2, wherein the cooling medium is a natural cooling medium.

5. The hermetic rotary compressor according to claim 4, wherein the natural cooling medium is one of carbon dioxide and ammonia.

6. A hermetic rotary compressor comprising:

a hermetic case for retaining lubricating oil in an inner bottom portion thereof, and having a discharge pressure introducing pipe arranged below an oil face of the lubricating oil during an operating time;

an electric motor section arranged within the hermetic case; and a compressing mechanism section of a rotary type having:

a first cylinder including a first eccentric roller connected to the electric motor section, and a first cylinder room for eccentrically rotatably storing the first eccentric roller, the first cylinder being arranged within the hermetic case;

a first vane for dividing the first cylinder room into two portions along the rotating direction of the first eccentric roller, the first vane being arranged within the first cylinder and pressed and biased so as to make a tip edge thereof abut on a circumferential face of the first eccentric roller;

a first vane room for storing a side end portion of the first vane, the first vane room being arranged on a side opposite the first cylinder room with respect to the first vane;

a spring member for pressing and biasing the first vane, the spring member being arranged in the first vane room;

a second cylinder including a second eccentric roller coaxially connected to the electric motor section with respect to the first eccentric roller, and a second cylinder room for eccentrically rotatably storing the second eccentric roller, the second cylinder being arranged in a position separated from a position of the first cylinder within the hermetic case;

a second vane for dividing the second cylinder room into two portions along the rotating direction of the second eccentric roller, the second vane being arranged within the second cylinder and pressed and biased so as to make a tip edge thereof abut on a circumferential face of the second eccentric roller; and a second vane room for storing a side end portion of the second vane, the second vane room being arranged on a side opposite the second cylinder room with respect to the second vane; and a pressure introducing pipe communicating with an interior of the second vane room;

wherein discharge ports of the first cylinder and the second cylinder are opened into the hermetic case.

7. A refrigerating cycle device comprising

A) a hermetic rotary compressor comprising:

a hermetic case for retaining lubricating oil in an inner bottom portion thereof and having a discharge pressure introducing pipe arranged below an oil face of the lubricating oil during an operating time;

an electric motor section arranged within the hermetic case; and a compressing mechanism section of a rotary type having:

a first cylinder including a first eccentric roller connected to the electric motor section, and a first cylinder room for eccentrically rotatably storing the first eccentric roller, the first cylinder being arranged within the hermetic case;

a first vane for dividing the first cylinder room into two portions along the rotating direction of the first eccentric roller, the first vane being arranged within the first cylinder and pressed and biased so as to make a tip edge thereof abut on a circumferential face of the first eccentric roller;

a first vane room for storing a side end portion of the first vane, the first vane room being arranged on a side opposite the first cylinder room with respect to the first vane;

a spring member for pressing and biasing the first vane, the spring member being arranged in the first vane room;

a second cylinder including a second eccentric roller coaxially connected to the electric motor section with respect to the first eccentric roller, and a second cylinder room for eccentrically rotatably storing the second eccentric roller, the second cylinder being arranged in a position separated from a position of the first cylinder within the hermetic case;

a second vane for dividing the second cylinder room into two portions along the rotating direction of the second eccentric roller, the second vane being arranged within the second cylinder and pressed and biased so as to make a tip edge thereof abut on a circumferential face of the second eccentric roller; and a second vane room for storing a side end portion of the second vane, the second vane room being arranged on a side opposite the second cylinder room with respect to the second vane;

wherein cooling medium gas compressed in the compressing mechanism section is discharged into the hermetic case and the interior of the hermetic case becomes high pressure;

B) a condenser connected to a high pressure gas discharge pipe of the hermetic rotary compressor;

C) an expansion valve connected to the condenser;

D) an evaporator connected to the expansion valve;

E) an accumulator connected to the evaporator and having a first sucking pipe communicating with the first cylinder room and a second sucking pipe communicating with the second cylinder room, the second sucking pipe being branched to a sucking pressure introducing pipe; and a pressure switching mechanism for switching pressure between the discharge pressure introducing pipe and the sucking pressure introducing pipe, the pressure switching mechanism sending the switched pressure to the second vane room.

8. The refrigerating cycle device according to claim 7, wherein the hermetic rotary compressor further has a pressure introducing pipe communicating with an interior of the second vane room, and the pressure switching mechanism has a first opening-closing valve arranged between the discharge pressure introducing pipe and the pressure introducing pipe, and a second opening-closing valve arranged between the sucking pressure introducing pipe and the pressure introducing pipe.

* * * * *